United States Patent [19]

Goacher, Sr.

[11] Patent Number: 4,752,979

[45] Date of Patent: Jun. 28, 1988

[54] SWIMMING POOL WINTERIZING DEVICE

[76] Inventor: Darrell D. Goacher, Sr., 1317 Ninth St., Cottage Hills, Ill. 62018

[21] Appl. No.: 44,240

[22] Filed: Apr. 30, 1987

[51] Int. Cl.[4] ..... E04H 3/18

[52] U.S. Cl. ..... 4/496; 285/185

[58] Field of Search ..... 4/496, 506–510, 4/DIG. 1; 137/509.5, 509; 285/185; 138/32; 137/301

[56] References Cited

U.S. PATENT DOCUMENTS

| | | | |
|---|---|---|---|
| 746,828 | 12/1903 | Guyer | 285/185 |
| 1,140,720 | 5/1915 | Simons | 285/185 |
| 4,092,746 | 6/1978 | Harris | 4/507 |

FOREIGN PATENT DOCUMENTS

| | | | |
|---|---|---|---|
| 0096711 | 1/1872 | France | 285/185 |
| 0743927 | 4/1933 | France | 285/185 |
| 0002124 | of 1867 | United Kingdom | 285/185 |
| 0002902 | of 1868 | United Kingdom | 285/185 |
| 0001545 | of 1872 | United Kingdom | 285/185 |
| 0004206 | of 1883 | United Kingdom | 285/185 |
| 0006918 | of 1909 | United Kingdom | 285/185 |
| 0162386 | 4/1921 | United Kingdom | 285/185 |
| 0382992 | 11/1932 | United Kingdom | 285/185 |
| 0846230 | 8/1960 | United Kingdom | 285/185 |

*Primary Examiner*—Henry J. Recla
*Assistant Examiner*—L. J. Peters
*Attorney, Agent, or Firm*—Edward R. Weber

[57] ABSTRACT

A device which will allow removal of water from the pipes and associate equipment servicing a swimming pool without partially draining the pool consisting of a first member equipped with means for water-tight engagement with an outlet in the sidewall of a pool structure and a second member equipped with a standpipe. When the first and second members are tightened into water-tight relationship, a vent is provided from the outlet in the sidewall of the pool to the outside air. The water in the pipe associated with the outlet can then be removed without the necessity of draining any water from the pool.

16 Claims, 1 Drawing Sheet

SWIMMING POOL WINTERIZING DEVICE

FIELD OF THE INVENTION

This invention relates to apparatus which facilitates the winterizing of a swimming pool.

BACKGROUND OF THE INVENTION

During recent years, an increasing number of swimming pools have been constructed in areas of the country where freezing temperatures are encountered during the winter. Due to the fact that water expands when it freezes, it is necessary to protect the pools, as well as the pipes and equipment servicing the pools, from damage caused by freezing. It has been found that in all but the most severe climates, the pool structure itself may be adequately protected by leaving the pool filled with water and placing logs or other floating devices in the water to prevent a solid layer of ice from forming on the surface of the water. Such protection, however, is not suitable for the pipes and equipment servicing the pool, since even in relatively temperate climates, the pipes freeze solid and, as a result of the expansion of the water, sometimes burst. To prevent the rupture of the pipes, it is therefore necessary to remove the water from the pipes prior to the time when freezing temperatures are encountered.

One popular method of accomplishing this is to lower the level of the water in the pool to an elevation just below the openings where the lines penetrate the pool wall. For convenience, these openings will be called outlets regardless of whether water flows into or out of the pool. The water is then blown from the lines and the lines are allowed to remain empty. In a variation of this, once the lines have been emptied, the outlets are plugged, and the water level in the pool is then returned to a near normal level. This latter approach is done to provide better protection to the pool structure itself. In either instance, thousands of gallons of water are lost through the process of partially draining and refilling the pool with water. In addition to requiring a considerable amount of time to partially drain and refill the pool, the cost of the water in many areas can be considerable.

Various devices have been conceived to eliminate the need for lowering the water level. Certain of these consist of a cofferdam like structure which may be affixed to the side of the pool to reduce the amount of water which must necessarily be removed to lower the water level to below the outlets. Examples of these devices are shown in U.S. Pat. Nos. 3,858,597 and 4,092,746. Other devices involve the use of relatively complex check valve systems, such as those illustrated in U.S. Pat. Nos. 4,281,422 and 4,368,550. Each of these types of devices has presented problems in use, including the complexity of the check valves and difficulties with affixing the cofferdam like structures to the side of the pool.

It has therefore among the objects of the invention to provide an inexpensive, simple device which will allow removal of water from the pipes and associated equipment servicing a swimming pool without draining the pool and without the difficulties associated with complex check valve systems and cofferdam systems. A further object of the invention is to provide a device which will facilitate keeping the pipes empty throughout the period when freezing conditions are anticipated.

SUMMARY OF THE INVENTION

The present invention is installed in the outlets where the pipes connect with the pool structure and permits the pipes to be emptied of water without the necessity of lowering the water level in the pool. In the simplest form, a device may be a member, which sealably engages the outlets in the pool wall, and a standpipe, which exits at an angle to the threaded member and extends beyond the surface of the pool to a level above any level which the pool water might attain.

One of the problems encountered with such a device has been that of orienting the standpipe with respect to the threaded member so that when the threaded member is tightened in the outlet, the standpipe will extend above the pool sidewall. Pools are increasingly constructed with plastic pipes and plastic outlets. Such outlets are not able to withstand a large amount of tightening force. As a result, it is not possible to merely tighten the threaded member in the outlet until the standpipe extends upward. Only a minor variation in the orientation of the threaded outlet will prevent proper orientation of the standpipe and excessive tightening may strip the threads in the outlet. A means was thus needed to permit the threading of a member into sealable engagement with the outlet in the pool without the need for excessive tightening to properly orient the standpipe so that it extends above the pool sidewall.

In the instant invention, this has been accomplished via use of a two-component structure. The first component is threadably engaged with the pool sidewall and is tightened until it is in water-tight engagement therewith. The second component, which may be loosely affixed to the first component, is then oriented so that the standpipe, which is part of the second component, extends above the pool sidewall and is tightened into water-tight relationship with the first component. A vent is thus provided from the plumbing line in the sidewall of the pool to the outside air. The water in the line can then be removed without the necessity of draining any water from the pool.

BRIEF DESCRIPTION OF THE DRAWINGS

In the accompanying drawings, in which one of various possible embodiments of the invention is illustrated.

DETAILED DESCRIPTION OF THE DRAWINGS

Figure 1:
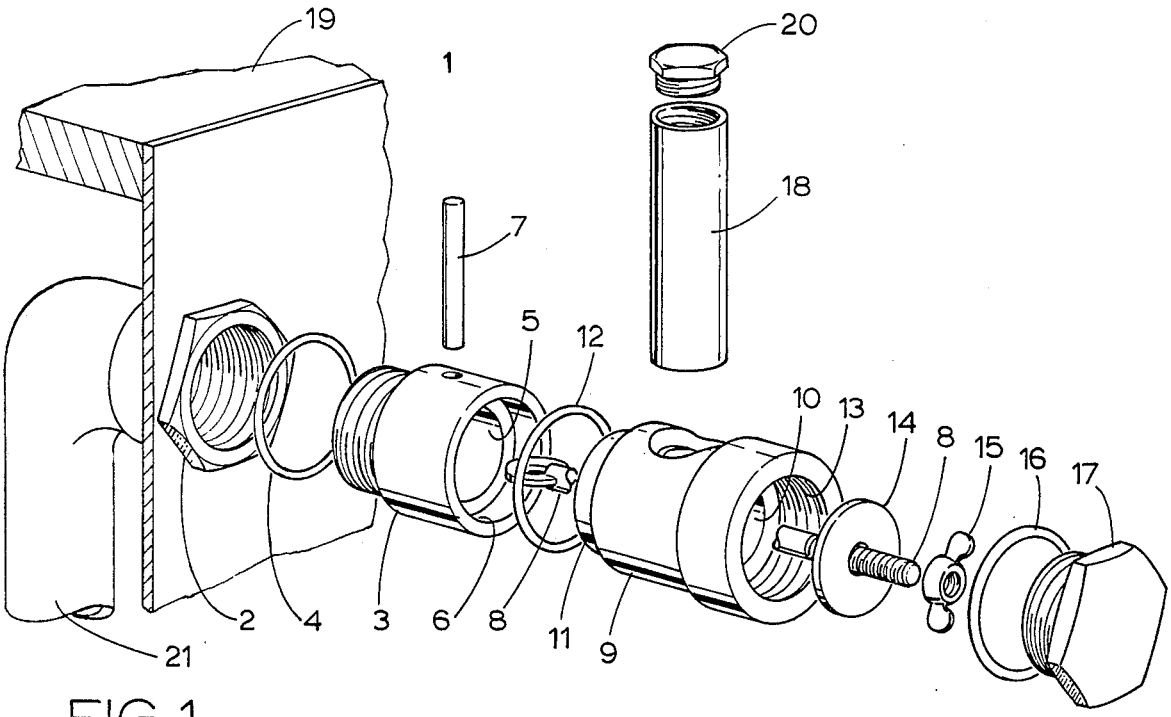
FIG. 1 is an exploded perspective view of the device of the instant invention showing the relationship between the components thereof.
Figure 2:
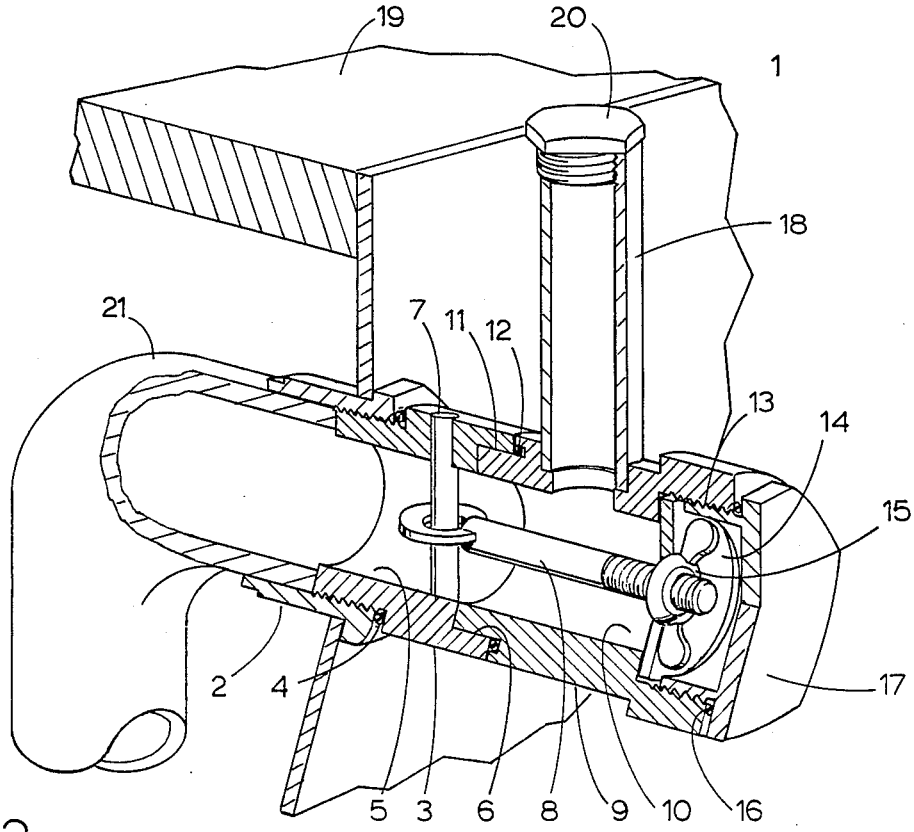
FIG. 2 is a cross-sectional view of the device of the instant invention installed in a pool.

Referring now to the drawings wherein like characters represent like elements, the typical swimming pool structure is generally designated by the numeral 1. Attached to the side of swimming pool structure 1 is threaded outlet 2, which penetrates the pool wall and connects pipe 21 to the interior of the pool. Threaded member 3 and seal 4 mate with the threads on outlet 2. As threaded member 3 is tightened, seal 4 becomes compressed and creates a water-tight seal between threaded member 3 and outlet 2.

In the illustrated preferred embodiment, threaded member 3 has an interior bore 5 passing along its central axis. An enlarged counterbore 6 is at the end opposite the threads. Threaded member 3 is also fitted with a transverse pin 7 and a bolt 8. The attachment between transverse pin 7 and bolt 8 is such that a certain limited rotational movement of bolt 8 around transverse pin 7 is permitted. A second member 9 has an interior bore 10, the diameter of which is compatible to interior bore 5. One end of member 9 has a reduced diameter portion 11, which mates with enlarged counterbore 6 of member 3. Bolt 8 passes through member 9. A second seal 12 is placed between second member 9 and member 3 to permit members 3 and 9 to be tightened into water-tight engagement. Member 9 is also provided with a threaded counterbore section 13 at the end opposite reduced diameter portion 11. The device of the invention is further provided with a disc 14 with a central hole sized to permit bolt 8 to pass through. Disc 14 is sized to mate with counterbore 13. When members 3 and 9 and seal 12 are aligned, disc 14 is placed over bolt 8 and nut 15 is tightened on bolt 8 until members 3 and 9 and seal 12 unite into water-tight engagement. A third seal 16 and a threaded plug 17 are mated with threaded counterbore section 13 so as to prevent the entry of water into mated interior bores 5 and 10 through threaded counterbore section 13. Member 9 is further provided with a standpipe 18 of sufficient length to extend above deck 19 of swimming pool structure 1 and a plug 20 which engages and seals the open end of standpipe 18.

In use, threaded member 3 and seal 4 are tightened into threaded outlet 2 until seal 4 is sufficiently compressed to provide a water-tight seal. Member 9 and its associated parts may be loosely assembled to threaded member 3 during this installation or may be subsequently assembled. This assembly consists of positioning seal 12 around bolt 8. Member 9 is then placed over bolt 8 so that reduced diameter portion 11 mates with counterbore 6. Interior bore 5 of threaded member 3 will then be in communication with interior bore 10 of member 9. Disc 14 is placed over bolt 8 and inserted into threaded counterbore 13. Nut 15 is partially tightened on bolt 8 until threaded member 3 and member 9 are loosely engaged. Member 9 is then rotated so that standpipe 18 extends above the level of deck 19 and nut 15 is tightened so as to draw threaded member 3 and member 9 into water-tight, non-rotating relationship. At this point seal 16 is installed between plug 17 and member 9 and the plug is threaded into threaded counterbore 13 until seal 16 is compressed sufficiently to provide a water-tight seal. It is thus seen that the installed assembly provides a continuous interior bore consisting of bores 5, 10 and standpipe 18, which provides a path of communication whereby pipe 21 of swimming pool structure 1 is extended above the deck level 19 of swimming pool structure 1. Once all water has been removed from pipe 21, extended interior bores 5, 10 and standpipe 18, plug 20 is inserted into the open end of standpipe 18 to prevent moisture from entering. Thus it is seen that an inexpensive device has been provided which may be installed in a pool fitting without the necessity of lowering the water in the swimming pool and which permits all of the water to be drained from the line associated with said pool fitting.

It will be appreciated that in the spring when there is a desire to reactivate the pool, removal of the fitting is extremely simple. All that is necessary is to remove threaded plug 17, loosen nut 15 to permit member 9 to rotate with respect to threaded member 3, and unscrew threaded member 3 from threaded outlet 2.

It will be understood that in the event that outlet 2 is unthreaded, any of several known methods of engaging an unthreaded opening may be used to fasten member 3 to outlet 2. Among these are expending members which engage the interior bore of outlet 2, adapters which may be bonded within outlet 2, and clamps which engage the exterior of outlet 2. Any method is suitable which will permit member 3 and outlet 2 to be fastened in water-tight engagement. Material of construction can be any of the widely know materials which possess the necessary physical characteristics, such as imperviousness to water, and physical strength. Selection of suitable material is well within the capability of any person skilled in the art. Likewise, it will be understood that the device may be used in numerous other applications with different structures and various fluids.

As various changes could be made in the above constructions and methods without departing from the scope of the invention, it is intended that all matter contained in the above description or shown in the accompanying drawings shall be interpreted as illustrative and not in a limiting sense. The invention accordingly comprises the constructions and methods hereinafter described, the scope of the invention being indicated in the following claims.

What is claimed is:

1. A swimming pool winterizing device consisting of a first tubular member having a first end provided with means for removably fastening said first end of said first tubular member in water-tight engagement with an outlet fitting in a swimming pool structure and a non-threaded second end opposite said first end; a second tubular member having a first end in non-threaded rotational engagement with said second end of said first tubular member whereby the interior of said first tubular member and the interior of said second tubular member are in a communicating relationship; a third tubular member having a first end affixed to said second tubular member and a second end separated from said second tubular member by the length of said third tubular member so that the interior of said third tubular member and the interior of said second tubular member are in a water-tight communicating relationship; means for fastening said first tubular member and said second tubular member in non-rotating, water-tight engagement so as to establish a continuous, water-tight passage from the said first end of said first tubular member through said second tubular member and said third tubular member whereby said passage terminates at the second end of said third tubular member; and means for creating a water-tight closure of said second end of said third tubular member.

2. A swimming pool winterizing device according to claim 1 wherein said third tubular member is affixed to said second tubular member such that the axis of said third tubular member approximates a perpendicular engagement with the axis of said second tubular member.

3. A swimming pool winterizing device according to claim 1 whereby the means for removably fastening said first end of said first tubular member of said swimming pool winterizing device to the outlet fitting of a swimming pool structure consists of threads constructed to mate with threads in the outlet fitting of the swimming pool structure.

4. A swimming pool winterizing device consisting of a first member having a first threaded end constructed so as to threadably engage an outlet fitting in a swimming pool structure, a sealing member installed on said first end of said first member so as to create a water-tight seal when said first member is threadably engaged with said outlet fitting of said swimming pool structure, a passageway through the interior of said first member from said first threaded end to a non-threaded second end of said first member; a second member having a non-threaded first end constructed to rotatably engage said second end of said first member, a seal interposed between said first end of said second member and said second end of said first member whereby a water impervious connection may be created between said first member and said second member, a passageway through the interior of said second member from said first end of said second member to a second end of said second member which communicates with the passageway from said first end of said first member to said second end of said first member when said first member and said second member are rotatably engaged; a third member having a first end attached to said second member and a second end remote from said second member, said third member further having an interior passageway in water-tight communication with the interior passageway of said second member; means for affixing said first member and said second member in non-rotating, water-tight engagement; means for sealing said second end of said second member so that a water-tight passageway is created from said first end of said first member through said first member, said second member, and said third member and terminating at said second end of said third member; and means for closing said second end of said third member to prevent entry of water therein.

5. A winterizing device according to claim 4 wherein the axis of the interior passageway of said third tubular member communicates with the axis of the interior passageway of said second tubular member such that the axis of said third tubular member approximates a perpendicular engagement with the axis of said second tubular member.

6. A method of winterizing pipes associated with a substantially water-filled structure which has one or more pipes penetrating the side of said structure through outlet fittings which either remove or introduce water into said structure wherein a device is installed into an outlet fitting, which device consists of a first tubular member having a first end provided with means for removably fastening said first end of said first tubular member in water-tight engagement with said outlet fitting and a non-threaded second end opposite said first end, a second tubular member having a non-threaded first end rotatably engaged with said second end of said first tubular member, said second tubular member having a third tubular member protruding therefrom, said third tubular member having a first end in water-tight communication with the interior of said second tubular member and a second end remote from said second tubular member, rotating said second tubular member with respect to said first tubular member to an orientation such that the second end of said third tubular member is above the surface of the water in said substantially water-filled structure, affixing said first tubular member and said second tubular member in non-rotating, water-tight engagement when the desired orientation of said third tubular member with respect to the surface of the water in said substantially water-filled structure is attained, thereby creating a contiuous, water-tight channel from the interior of said pipe to the exterior air, said channel passing through said outlet fitting, the interior of said first tubular member, the interior of said second tubular member, and the interior of said third tubular member and terminating at the second end of said third tubular member, removing substantially all the water from said pipe and said associated continuous, water-tight channel and closing said second end of said third tubular member so that no water may enter said pipe and said associated continuous, water-tight channel.

7. A method of winterizing a substantially water-filled structure according to claim 6 wherein said third tubular member is affixed to said second tubular member such that the axis of said third tubular member approximates a perpendicular engagement with the axis of said second tubular member.

8. A method of winterizing a substantially water-filled structure according to claim 6 whereby the means for removably fastening said first end of said first tubular member of said device to the outlet fitting of said substantially water-filled structure consists of threads which mate with threads in the outlet fitting of said substantially water-filled structure.

9. A method of evacuating a pipe associated with a substantially fluid-filled structure having one or more pipes which penetrate the side of said structure through outlet fittings and which remove or introduce fluid into said structure, which consists of installing a device into said outlet fitting, which device consists of a first tubular member having a first end provided with means for removably fastening said first end of said first tubular member in fluid-tight engagement with said outlet fitting and a non-threaded second end opposite said first end, which second end is in rotatable engagement with a non-threaded first end of a second tubular member, said second tubular member having a third tubular member in non-rotating, fluid-tight engagement therewith, which third tubular member has a first end in communication with the interior of said second tubular member and a second end remote from said second tubular member, rotating said second tubular member with respect to said first tubular member until the second end of said third tubular member is positioned above the surface of the fluid in said substantially fluid-filled structure, affixing said first tubular member and said second tubular member in non-rotating, fluid-tight engagement when the desired orientation of said third tubular member with respect to the surface of the fluid in said substantially fluid-filled structure is attained, such that a continuous fluid-tight channel is established which connects the interior of the aforementioned pipe with the space above the surface of fluid in the substantially fluid-filled structure, removing substantially all fluid from said pipe and said associated continuous, fluid-tight channel passing through said outlet fitting, said first tubular member, said second tubular member, and said third tubular member, and sealing the end of said third tubular member so that said pipe and said associated continuous fluid-tight channel are maintained in a fluid free state.

10. A method of evacuating a pipe associated with a substantially fluid-filled structure according to claim 9 wherein said third tubular member is affixed to said second tubular member such that the axis of said third tubular member approximates a perpendicular engagement with the axis of said second tubular member.

11. A method of evacuating a pipe associated with a substantially fluid-filled structure according to claim 9 whereby the means or removably fastening said first end of said first tubular member of said device to the outlet fitting of said pipe consists of threads which mate with threads in the outlet fitting of said pipe.

12. A device consisting of a first member having a first end provided with means for removably fastening said first end of said first member in non-rotating, fluid-tight engagement with an outlet fitting which fitting connects a pipe to the interior of a substantially fluid-filled structure, a passageway through the interior of said first member from said first end to a non-threaded second end of said first member; a second member having a non-threaded first end constructed to rotatably engage said second end of said first member, means for creating a fluid-tight seal between said first end of said second member and said second end of said first member, a passageway through the interior of said second member from said first end of said second member to a second end of said second member which communicates with the passageway from said first end of said first member to said second end of said first member when said first member and said second member are rotatably engaged; a third member having a first end in fluid-tight engagement with said second member, said third member further having an interior passageway in fluid-tight communication with the interior passageway of said second member where the first end of said third member engages said second member; means for affixing said first member and said second member in non-rotating, fluid-tight engagement; means for sealing said second end of said second member so that a fluid-tight passageway is created from said first end of said first member through said first member, said second member, and said third member, said fluid-tight passageway terminating at said second end of said third member; and means for closing said second end of said third member to prevent entry of fluid therein.

13. A device according to claim 12 wherein the axis of the interior passageway of said third member communicates with the axis of the interior passageway of said second member such that the axis of said third member approximates a prependicular engagement with the axis of said second member.

14. A method of evacuating a pipe associated with a substantially fluid-filled structure having one or more pipes which penetrate the side of said structure through outlet fittings and which either remove or introduce fluid into said structure, which consists of installing a device in non rotating, fluid-tight engagement in said outlet fitting, which device consists of a first member having a first end provided with means for removably fastening said first end of said first member in non-rotating, fluid-tight engagement with said outlet fitting, a passageway through the interior of said first member from said first end to a non-threaded second end opposite said first end, which second end is in rotatable engagement with a non-threaded first end of a second member, a passageway through the interior of said second member which passageway is in communication with the passageway in said first member, said second member having a third member in non-rotating, fluid-tight engagement therewith, which third member has a passageway in fluid-tight communication with the passageway of said second member, which passageway communicates with a second end of said third member remote from said second member, rotating said second member with respect to said first member until the second end of said third member is positioned above the surface of the fluid in said substantially fluid-filled structure, affixing said first member and said second member in non-rotating, fluid-tight engagement when the desired orientation of said third member with respect to the surface of the fluid in said substantially fluid-filled structure is attained, such that a continuous fluid-tight channel is established which connects the interior of the aforementioned pipe with the space above the surface of fluid in the substantially fluid-filled structure, removing substantially all fluid from said pipe and said associated continuous, fluid-tight channel passing through said outlet fitting, said first member, said second member, and said third member, and sealing the second end of said third member so that said pipe and said associated continuous fluid-tight channel are maintained in a fluid free state.

15. A method of evacuating a pipe associated with a substantially fluid-filled structure according to claim 14 wherein said third member is affixed to said second member such that the axis of said third member approximates a perpendicular engagement with the axis of said second member.

16. A method of evacuating a pipe associated with a substantially fluid-filled structure according to claim 14 whereby the means for removably fastening said first end of said first member of said device to the outlet fitting of said substantially fluid-filled structure consists of threads which mate with threads in the outlet fitting of said substantially fluid-filled structure.

* * * * *